United States Patent [19]

Bartholic

[11] 4,256,567

[45] Mar. 17, 1981

[54] TREATMENT OF PETROLEUM STOCKS CONTAINING METALS

[75] Inventor: David B. Bartholic, Watchung, N.J.

[73] Assignee: Engelhard Minerals & Chemicals Corporation, Edison, N.J.

[21] Appl. No.: 79,227

[22] Filed: Sep. 26, 1979

Related U.S. Application Data

[63] Continuation-in-part of Ser. No. 38,928, May 14, 1979, which is a continuation-in-part of Ser. No. 875,326, Feb. 6, 1978, abandoned.

[51] Int. Cl.[3] ..... C10G 53/10; C10G 53/08

[52] U.S. Cl. ..... 208/252; 208/90; 208/273; 208/301

[58] Field of Search ..... 208/252 R, 273, 301, 208/126, 90

[56] References Cited

U.S. PATENT DOCUMENTS

| | | | |
|---|---|---|---|
| 1,759,744 | 5/1930 | Gard et al. | 208/273 |
| 1,791,926 | 2/1931 | Gallagher | 208/273 |
| 2,035,349 | 3/1936 | Smith | 208/273 |
| 2,378,531 | 6/1945 | Becker | 208/91 |
| 2,462,891 | 3/1949 | Noll | 208/149 |
| 2,472,723 | 6/1949 | Peet | 208/149 |

*Primary Examiner*—Herbert Levine

*Attorney, Agent, or Firm*—Inez L. Moselle

[57] ABSTRACT

Petroleum crudes, residual stocks, gas oils and the like which contain metals are pretreated with a sulfonating agent and the mixture separated into two fractions of which the lesser in volume has a greater concentration of metal and Conradson Carbon components. One or both of those fractions is mixed with a catalytically inert solid at high temperature to transfer metallic compounds and Conradson Carbon components to the solid for improvement of the fraction.

8 Claims, 1 Drawing Figure

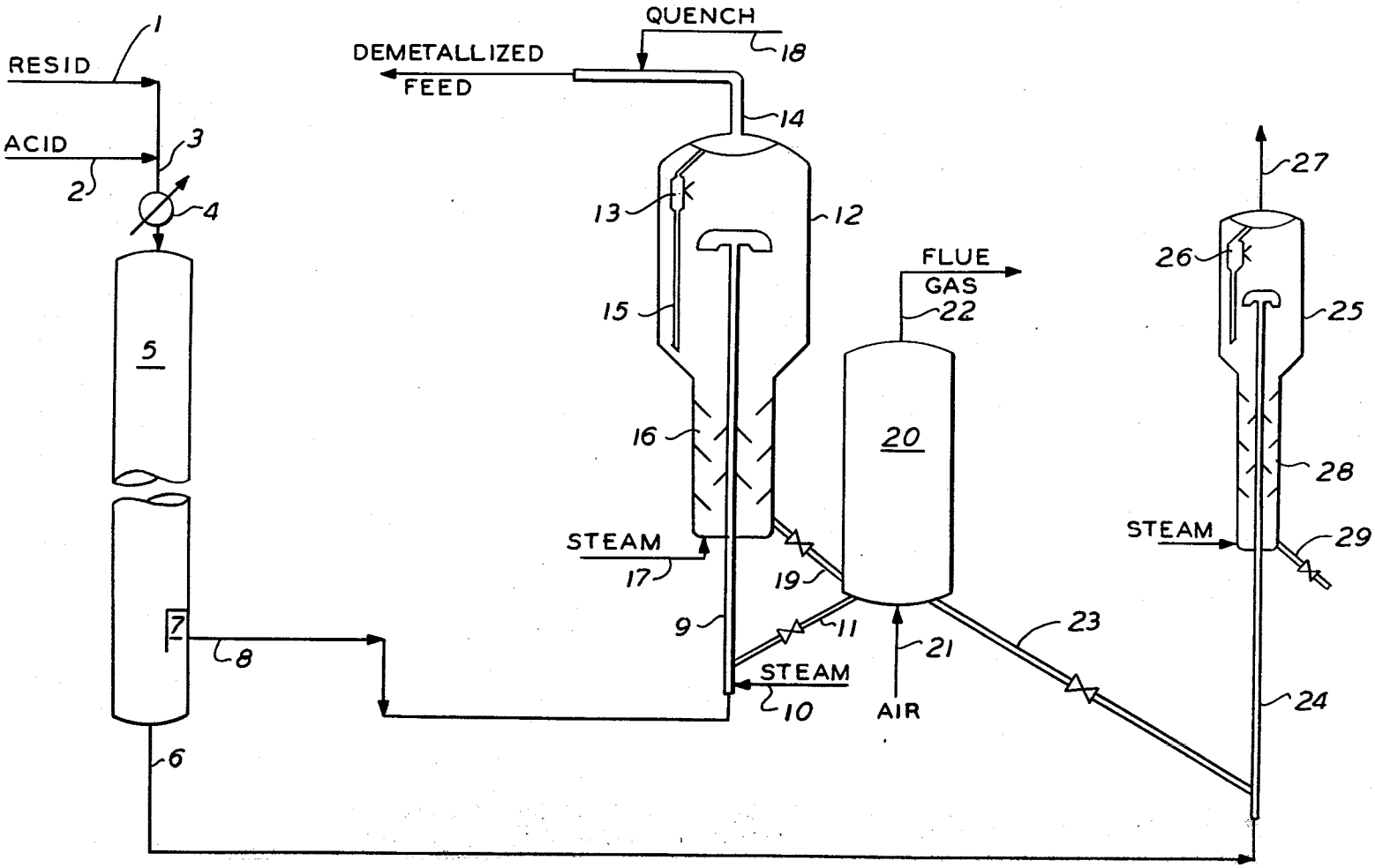
RESID
ACID
QUENCH
DEMETALLIZED FEED
FLUE GAS
AIR
STEAM
STEAM
STEAM
1
2
3
4
5
6
7
8
9
10
11
12
13
14
15
16
17
18
19
20
21
22
23
24
25
26
27
28
29

TREATMENT OF PETROLEUM STOCKS CONTAINING METALS

CROSS-REFERENCE TO RELATED APPLICATIONS

This application is a continuation-in-part of my copending application Ser. No. 038,928, filed May 14, 1979, which, in turn, is a continuation-in-part of my application Ser. No. 875,326, filed Feb. 6, 1978 now abandoned.

BACKGROUND OF THE INVENTION

The invention is concerned with increasing the portion of heavy petroleum crudes which can be utilized as catalytic cracking feedstock to produce premium petroleum products, particularly motor gasoline of high octane number. The heavy ends of many crudes are high in Conradson Carbon and metals which are undesirable in catalytic cracking feedstocks. The present invention provides an economically attractive method for selectively removing and utilizing these undesirable components from the residues of atmospheric and vacuum distillations, commonly called atmospheric and vacuum residua or "resids" and also contemplates improvement of lighter stocks such as gas oils. The undesirable CC (for Conradson Carbon) and metal bearing compounds present in the crude tend to be concentrated in the resids and other high boiling fractions because most of them are of high boiling point. The invention provides a method for processing whole crudes and crude fractions high in Conradson Carbon and metals to provide feedstock for catalytic cracking and for other purposes.

When catalytic cracking was first introduced to the petroleum industry in the 1930's, the process constituted a major advance in its advantages over the previous technique for increasing the yield of motor gasoline from petroleum to meet a fast-growing demand for that premium product. The catalytic process produces abundant yields of high octane naphtha from petroleum fractions boiling above the gasoline range, upwards of about 400° F. Catalytic cracking has been greatly improved by intensive research and development efforts and plant capacity has expanded rapidly to a present-day status in which the catalytic cracker is the dominant unit, the "workhorse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker are adversely effected.

The effect of higher Conradson Carbon is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, at least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottleneck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. The lighter ends of the cracked product, butane and lighter, are processed through fractionation equipment to separate components of value greater than fuel to furnaces, primarily propane, butane and the olefins of like carbon number. Hydrogen, being incondensible in the "gas plant", occupies space as a gas in the compression and fractionating train and can easily overload the system when excessive amounts are produced by high metal content catalyst, causing reduction in charge rate to maintain the FCC unit and auxiliaries operative.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780° to 840° F. During the long residence time at this temperature, the charge is converted to coke and distillate products taken off the top of the drum for recovery of "coker gasoline", "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for FCC charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts. It is often desirable to treat the gas oils by expensive hydrogenation techniques before charging to catalytic cracking. Coking does reduce metals and Conradson Carbon but still leaves an inferior gas oil for charge to catalytic cracking.

Catalytic charge stock may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked naphtha. Low temperature, liquid phase sorption on catalytically inert silica gel is proposed by Shuman and Brace, OIL AND GAS JOURNAL, Apr. 16, 1953, page 113.

It is also known to separate heavy metals and CC components from petroleum stocks by treating with acids and separating two resultant phases. Such use of hydrogen fluoride is described in Adams et al. U.S. Pat. No. 3,245,902 dated Apr. 12, 1966. Similar use of polyphosphoric acids is the subject of Tilley et al. U.S. Pat. No. 3,622,505. Phosphate and phosphite ethers and esters may be used in combination with acids according to Abstract 84:108271 at page 161 of Chem Abst. vol. 84 (1976).

Sulfuric acid and related compounds have been proposed for the purpose in a variety of modes. See Kimberlin et al. U.S. Pat. No. 2,902,430 and No. 2,926,129. Sulfonic acids are so used according to Erdman U.S. Pat. No. 3,190,829 and No. 3,082,167. See also Middleton U.S. Pat. No. 2,940,977 and Case et al. U.S. Pat. No. 2,948,675. In some such disclosures it is proposed to add diluents to aid in separation of immiscible phases to facilitate decantation, centrifuging and the like.

A recent development in upgrading petroleum and like stocks such as those derived from tar sands, shale oil, coal dissolution etc., is very short time contact at elevated temperature with an inert solid at elevated temperature. Such processes are described in copending application Ser. No. 875,326, filed Feb. 6, 1978, the entire contents of which is incorporated herein by this reference.

SUMMARY OF THE INVENTION

It has now been found that the short term, high temperature contact with inerts for reducing metals and Conradson Carbon is improved by pretreatment of the charge stock with a sulfonating agent such as $SO_3$, sulfuric acid, alkyl and aromatic sulfonic acids and related agents, many of which are described in the prior art cited above. According to this invention, the petroleum fraction so treated is separated into two fractions, at least one of which is subjected to high temperature, short time contact with inert solids in the manner described in my said application Ser. No. 875,326.

The invention affords wide flexibility in handling of the two fractions resulting from settling, centrifuging or like separation of the mixture resulting from treatment with a sulfonating agent. As will be apparent from the prior art cited above, acid treatment causes metal compounds and Conradson Carbon constituents to become more concentrated in a minor fraction of the treated oil, leaving low metal and CC values in the major fraction. The improved major fraction may be of sufficiently high quality to serve as cracking charge, fuel oil or other purpose in which low metals and CC are advantageous. In such case, only the minor portion having high metal and CC values is upgraded by high temperature contact with inert solids.

According to an embodiment of particular advantage in preparing charge for catalytic cracking, the two portions are subjected to such contact with hot inert solids in separate contactors. An attractive modification of that two contactor embodiment involves cascading inert solids from the first contactor (low CC metals portion of the treated petroleum) to the second contactor for the high metals charge to maintain a desired low level of metal on solids in the first contactor. This can be expected to increase gas and coke production in the second contactor and to deposit such quantities of metal on the inert solid therein as to make the same attractive as a source of such valuable metals as nickel and vanadium.

It is also contemplated to so conduct the acid treatment as to provide a very small quantity of the fraction in which metals are concentrated, leaving a substantial amount of metal in the major portion. In that embodiment, the major portion may be contacted with inert solids and the minor portion treated as a metal ore.

DESCRIPTION OF DRAWING

Equipment for practice of same preferred embodiments of the invention is diagrammatically illustrated in the annexed drawing.

DESCRIPTION OF PREFERRED EMBODIMENTS

As shown in that drawing, charge stock enters the process by line 1 to be mixed in line 3 with a sulfonating agent from line 2. The charge stock may be a whole crude, a topped crude, atmospheric or vacuum tower bottoms (resids), gas oils and the like; in general any hydrocarbon fraction from petroleum, tar sands, shale oil or like source which contain quantities of metals and/or CC components which render the fractions unsuited to refinery processing or sale as commercial fuel. The sulfonating agent may be any compound such as sulfuric acid, $SO_3$, alkyl sulfonic acids and aromatic sulfonic acids, many of which are described in the prior art cited above, together with discussion of their properties and manner of use for the present purpose. The mixture will be subjected to usual steps for inducing intimate contact of oil and the added reagent such as mixing nozzles, agitators, baffles and the like (not shown) before and/or after passing through heater 4 to adjust the temperature for satisfactory treatment of the charge. The intimate mixture then passes to time tank 5 for completion of reaction and separation into two phases; a minor portion rich in metal and CC and a major portion poor in metal and CC.

The sulfonating agent added by line 2 will be supplied in ratios of about 50 ppm to 10% weight percent based on nature of the hydrocarbon fraction treated and results desired. In general, minimum amounts will be correlated to metals content of the charge, roughly one ppm of sulfonating agent per ppm of metal in the charge. Maximum amounts will generally be correlated with lower temperatures of reaction with the sulfonating agent which may range from a high of about 600° F. down to ambient temperatures in the neighborhood of 60°-70° F. As with most reactions of this type, time, temperature and concentration of reagents are interdependent variables. At low concentration of sulfonating agent and low temperatures within the ranges stated, a long time of reaction should be provided, say 1 to 10 hours. This may be provided by suitable means known in the art such as baffled towers, elongated tubes and the like, preference being had for the time tank 5 as shown in the drawing. Adequate contact and settling by time tank can be expected for a 50,000 barrel per day plant with a tank 14 feet in diameter by 145 feet long.

As the reaction mixture approaches the bottom of time tank 5, the contents are coalescing to two phases of which the heavier constitutes about 5-25%, preferably about 15% of the total constituted by most of the CC and metal components together with residues of the sulfonating agent and reaction products of that agent. That heavier phase is withdrawn from the bottom of time tank 5 by line 6 for further processing in a manner presently to be described.

The lighter phase is constituted primarily by oil which is relatively low in metals and Conradson Carbon. That lighter phase accumulates at trap 7 to be withdrawn at line 8 as the major portion of the charge. With some charge stocks and severities of treatment, the metal and CC values of the stream in line 8 may be low enough to qualify as FCC charge or sale as commercial fuel and the invention contemplates alternative embodiments in which the lighter fraction is so diverted. When the invention is applied to charge stocks of very high metal and/or CC values, it may be preferable to conduct the treating step (in time tank 5) such that the metal and CC values of the lighter fraction are undesirably high for use as fuel or charge to catalytic cracking. Such fractions are subjected to the decarbonizing, demetallizing treatment described in my said application Ser. No. 875,326.

The decarbonizing, demetallizing step is preferably conducted in a contactor very similar in construction and operation to riser reactors employed in modern FCC units. The stream in line 8 is introduced to the bottom of a riser contactor 9. Steam and/or water in amounts to substantially decrease hydrocarbon partial pressure is added to the feedstock, from line 10. Pressures will be sufficient to overcome pressure drops, say 15 to 50 p.s.i.a. The charge may be preheated in a furnace, not shown, before introduction to the riser contactor, to any desired degree below thermal cracking temperature, e.g., 200° to 800° F., preferably 300° to 700° F. Higher temperatures will induce thermal cracking of the feed with production of low octane naphtha.

The feed diluted by steam rises in the contactor 9 at high velocity such as 40 feet per second. Hot inert solid in finely divided form is introduced to the feed from a standpipe 11 in a quantity and at a temperature to provide a mixture at a temperature in excess of 900° F. to volatilize all components of the feed except the very heavy compounds of high CC and high metal content.

The solid contacting agent is essentially inert in the sense that it induces minimal cracking of heavy hydrocarbons by the standard microactivity test (MAT) conducted by measurement of amount of gas oil converted to gas, gasoline and coke by contact with the solid in a fixed bed. Charge in that test is 0.8 grams of mid-Continent gas oil of 27° API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. Other solids include low surface area forms of silica gel and bauxite.

Inert solids usuable in the process are characterized by low surface area. Surface area is below 100 $m^2/g$ (BET using nitrogen absorption) preferably below about 50 $m^2/g$, and most preferably below about 25 $m^2/g$. For example, microspheres of calcined clay may be employed. These microspheres may be produced by spray drying an aqueous suspension of hydrated clay, preferably fine particle size kaolin clay, to produce microspheres and then calcining the microspheres at temperatures in the range of about 1600° F. to 2100° F. Reference is made to U.S. Pat. No. 3,647,718 to Haden et al for details of preparation of suitable microspheres from hydrated kaolin clay, noting that in the patent such microspheres are used as a reactant with caustic to form high surface area zeolite in situ, whereas in the present invention the microspheres are used in low surface area form and they do not undergo zeolite crystallization which would undesirably increase surface area and contribute unwanted catalytic activity. Typically the calcined clay microspheres have a surface area below about 15 $m^2/g$ and analyze about 51% to 53% (wt.) $SiO_2$, 41 to 45% $Al_2O_3$, and from 0 to 1% $H_2O$, the balance being minor amounts of indigenous impurities, notably iron, titanium and alkaline earth metals. Generally iron content (expressed as $Fe_2O_3$) is about ½2% by weight and titanium (expressed as $TiO_2$) is approximately 2%.

Other solids of low catalytic activity may be employed. Examples are: rutile, low surface area forms of alumina, magnesium oxide, sillimanite, andalusite, pumice, mullite, calcined coleminite, feldspar, fluorspar, bauxite, barytes, chromite, zircon, magnesite, nepheline, syenite, olivine, wollastonite, manganese ore, ilmenite pyrophyllite, talc (calcined fosterite), calcined dolomite, calcined lime, low surface area silica (e.g., quartz), perlite, slate, anhydrite and iron oxide ore. In general, solids of low cost are recommended since it will usually be necessary to discard a sizeable portion of the contact agent in the system from time to time and replace it with fresh agent to maintain a suitable level of metals. Since the solid is preferably of low porosity, resulting in deposition primarily on external surfaces, the invention contemplates abrading the particles as in a column of air at velocity to permit refluxing of solids for removal of external metal deposits with optional recycle of portions of metal-depleted abraded particles in the system. Typically inert fluidizable particles used in the process have a diameter in the range of 20 to 150 microns. The surface of the inert solid particles is usually within the range of 10 to 15 $m^2/g$. It is noted that the surface areas of commercial fluid zeolitic catalysts is considerably higher, generally exceeding values of 100 $m^2/g$. as measured by the B.E.T. method.

Length of the riser contactor 9 is such as to provide a very short time of contact between the feed and the contacting agent, less than 2 seconds, preferably 0.5 second or less. The contact time should be long enough to provide good uniformity of contact between feed and contacting agent, say at least 0.1 second.

At the top of the riser, e.g., 15 to 20 feet above the point of introduction of contacting agent from standpipe 11 at a feed velocity of 40 feet per second, vaporized hydrocarbons are separated as rapidly as possible from particulate solids bearing the high CC deposits and metals. This may be accomplished by discharge from the riser into a large disengaging zone defined by vessel 12. Vapors separate from entrained solids and discharge into cyclone separators 13 from which vapors are transferred to vapor line 14 while entrained solids drop into the disengaging zone by diplegs 15 to stripper 16 where steam admitted by line 17 evaporates traces of volatile hydrocarbons from the solids. The mixture of steam and hydrocarbons, together with entrained solids, enters cyclone 13 to disengage the suspended solids for return to stripper 16 by dipleg 15. As well known in the fluid cracking art, there may be a plurality of cyclones 13 and the cyclones may be multistage, with gas phase from a first stage cyclone discharging to a second stage cyclone.

In one embodiment, the cyclones 13 may be of the stripper cyclone type described in U.S. Pat. No. 4,043,899, the entire disclosure of which is hereby incorporated by this reference. In such case the stripping steam admitted to the cyclone may be at a low temperature, say 400° to 500° F., and serve to perform part or all of the quenching function presently to be described.

The vaporized hydrocarbons from cyclones 13 passing by way of line 14 are then mixed with cold hydrocarbon liquid introduced by line 18 to quench thermal cracking. The quenched product is cooled in a condenser and passed to an accumulator from which gases are removed for fuel and water is taken, preferably for recycle to the contactor for generation of steam to be used as an aid in vaporizing charge at the bottom of the riser and/or removing heat from the burner. Such elements are conventional and have been omitted from the drawing for simplicity.

In one embodiment, the quenching is advantageously conducted in a column equipped with vapor-liquid contact zones such as disc and doughnut trays and valve trays. Bottoms from such column quencher could go directly to catalytic cracking with overhead passing to the condenser and accumulator.

The liquid hydrocarbon phase from quenching in line 14 is a decarbonized and demetallized resid fraction which is now satisfactory charge for catalytic cracking, sale as fuel, etc. This product of contact in riser 9 may be used in part as the quench liquid at line 18. The balance is preferably transferred directly to a catalytic cracker.

Returning now to stripper 16, the inert solid particles bearing a deposit of high CC and metallic compounds passes by a standpipe 19 to the inlet of burner 20. Standpipe 19 discharges to a fluidized bed in burner 20 where it is fluidized by air introduced at line 21. Combustion of deposits from the inert solids maintains a high temperature of about 1150° to 1400° F. to restore the solids and to provide heat to the riser contactor 9. Products of combustion are discharged as flue gas at line 22.

The minor and heavier fraction withdrawn from time tank 5 by line 6 may vary quite widely in composition. With some heavy resid fractions, this portion may have a very high metals content, depending on severity of the treatment with sulfonating agent. In such case, it may be preferable to incinerate the fraction for steam generation under conditions to recover a slag or ash for metal values. In a preferred embodiment, the portion in line 6 constitutes about 15% of the total feed and is subjected to high temperature, short time contact with inert solids in a manner similar to that described for treatment of the major fraction withdrawn at line 8. The riser contactor for treating the minor fraction may be a self-contained unit of contactor and burner with circulating standpipes as above described. Alternatively, the riser contactor for the minor stream may operate on a slipstream from burner 20 of the unit for processing the major portion of the acid treated feed stock.

As noted above, it will be found desirable to withdraw a portion of the inert solids circulating through riser contactor 9 and burner 20 from time to time in order to maintain metal content of the solids below a desirable maximum and replace the withdrawn solids with fresh material. According to the embodiment illustrated in the drawing, the contact solids so withdrawn are taken from burner 20 by a standpipe 23 and passed to the bottom of a riser contactor 24 where they are mixed with high metals portion introduced by pipe 6. Riser contactor 24 operates in much the same fashion as riser contactor 9 but is of much smaller size, scaled down to accommodate the lesser feed stream from line 6.

The mixture of hot inert solids and high metals feed rises rapidly in riser contactor 24 to disengage in vessel 25 and discharge vapors through cyclone 26 and product line 27. Separated contact material passes through stripper 28 to discharge by standpipe 29. The decarbonized and demetallized vapors discharged at 27 will be quenched and liquid portion used as fuel, FCC feedstock or other disposition to which its properties are suited.

If possible, the contact material is used in riser contactor 24 on a once-through basis and discharged for use as ore for the few percent of valuable metals thereon. Those metals can be recovered by known hydrometalurgy techniques, thus restoring the contact material for reuse. In cases where the heat generated in burner 20 is not sufficient to supply the needs of both riser contactors, a portion of inert solids in standpipe 29 may be put through a burner and returned. Burning of contact material from standpipe 29 may be in the main burner 20, but is preferably conducted in a separate burner similar to and smaller than burner 20 in order to avoid mixing the very high metal content solids from riser contactor 24 with those supplied to riser contactor 9.

An atmospheric tower bottoms containing 9.9% Conradson Carbon and a 65% point on distillation at 1054° F. was treated with 5 wt. % para toluene sulfonic acid at 200° F. with agitation. Upon settling, a treated raffinate was decanted from about 5–10% of extract. The resid and raffinate were analyzed for metals by the carbon rod furnace and atomic absorption technique, finding values as reported in Table 1.

TABLE I

| | Metals in Resid and Raffinate, ppm | | | |
|---|---|---|---|---|
| | Cu | Ni | Fe | V |
| Resid | <1 | 13 | <1 | 50 |
| Raffinate | <1 | 5 | <1 | 25 |

The raffinate was contacted with inert solids of the nature described in the above cited Haden patent at conditions and with results described in Table 2. The runs were conducted in a fixed bed as above described for the MAT technique.

TABLE 2

| | Demetallizing Raffinate From Sulfonated Resid | | |
|---|---|---|---|
| Run No. | 1 | 2 | 3 |
| Reaction Parameters | | | |
| Solids/Oil Ratio, wt. | 4.69 | 4.94 | 4.75 |
| Space Velocity | 15.99 | 15.17 | 15.79 |
| Delivery Time (Sec.) | 48 | 48 | 48. |
| Max. Bed Temp., °F. | 910 | 908 | 908 |
| Min. Bed Temp., °F. | 880 | 868 | 866 |
| Mass Balance | 96.13 | 96.30 | 97.22 |
| Product Distribution, Wt. % | | | |
| $C_4$ and lighter | 2.65 | 2.82 | 3.24 |
| $C_5$ to 421° F. | 16.73 | 18.28 | 18.34 |
| 421 to 602° F. | 15.96 | 16.11 | 16.11 |
| 602° F. and heavier | 52.69 | 50.83 | 50.96 |
| Residue | 0.37 | 0.32 | 0.36 |
| Coke | 7.74 | 7.94 | 8.21 |
| Metals in Liquid Product, ppm | | | |
| Copper | <1 | <1 | <1 |

TABLE 2-continued

| Demetallizing Raffinate From Sulfonated Resid | | | |
|---|---|---|---|
| Run No. | 1 | 2 | 3 |
| Nickel | <1 | <1 | <1 |
| Iron | <1 | <1 | <1 |
| Vanadium | <1 | <1 | <1 |

I claim:

1. A process for upgrading a petroleum charge which contains high boiling components of substantial metal content and Conradson Carbon number which comprises mixing said charge with a sulfonating agent, separating the resultant mixture to provide a major raffinate fraction and a minor extract fraction and contacting one of said fractions in a confined rising vertical column with an inert solid material having a microactivity for catalytic cracking not substantially greater than 20 at low severity, including a temperature of at least about 900° F. for a period of time less than 2 seconds and less than that which induces substantial thermal cracking of said fraction, at the end of said period of time separating from said inert solid a decarbonized hydrocarbon product of reduced Conradson Carbon number as compared with said fraction and reducing temperature of said separated product to a level below that at which substantial thermal cracking takes place to terminate said period of time.

2. A process according to claim 1 wherein the said raffinate fraction is contacted with said inert solid material.

3. A process according to claim 1 wherein the said extract fraction is contacted with said inert solid material.

4. A process according to claim 1 wherein each of said raffinate and said extract fraction is separately contacted with said solid material.

5. A process according to claim 1 wherein said sulfonating agent is selected from the class consisting of sulfuric acid, $SO_3$, alkyl sulfonic acids and aromatic sulfonic acids.

6. A process according to claim 1 wherein the inert solid separated from said decarbonized hydrocarbon product is subjected to contact with oxidizing gas to burn carbonaceous deposits from said solid and to raise the temperature of said inert solid and the resultant high temperature inert solid is recycled to contact said fraction.

7. A process according to claim 4 wherein the inert solid separated from said decarbonized hydrocarbon product resulting from said contact by said raffinate fraction is subjectd to contact with oxidizing gas to burn carbonaceous deposite from said solid and to raise the temperature of said inert solid, a portion of the resultant high temperature inert solid is recycled to contact with said raffinate fraction and a portion of the resultant high temperature inert solid is contacted with said extract fraction.

8. A process according to claim 1 wherein said petroleum charge is a petroleum crude or a residual stock.

* * * * *